US006623409B1

(12) United States Patent
Abelbeck

(10) Patent No.: US 6,623,409 B1
(45) Date of Patent: Sep. 23, 2003

(54) AUTOMATIC LOCKING EXERCISE DEVICE AND METHOD

(76) Inventor: Kevin G. Abelbeck, 2524 S. Sepulveda Blvd., #302, Los Angeles, CA (US) 90064

( * ) Notice: Subject to any disclaimer, the term of this patent is extended or adjusted under 35 U.S.C. 154(b) by 220 days.

(21) Appl. No.: 09/690,866

(22) Filed: Oct. 17, 2000

(51) Int. Cl.[7] ..... A63B 21/078

(52) U.S. Cl. ..... 482/104; 482/98; 482/101; 482/110; 482/135

(58) Field of Search ..... 482/20, 38, 93, 482/94, 101, 104, 106, 107, 110, 133, 908, 135, 69, 116, 114, 98; 188/82.3, 82.34, 82.8

(56) References Cited

U.S. PATENT DOCUMENTS

| | | | | | |
|---|---|---|---|---|---|
| 4,252,314 | A | | 2/1981 | Ceppo | |
| 4,420,154 | A | | 12/1983 | Ramsey et al. | |
| 4,527,797 | A | | 7/1985 | Slade, Jr. et al. | |
| 4,549,734 | A | | 10/1985 | Hibler, Jr. et al. | |
| 4,750,739 | A | * | 6/1988 | Lange | 482/104 |
| 4,934,693 | A | | 6/1990 | Santoro | |
| 5,050,868 | A | | 9/1991 | Pearson | |
| 5,108,354 | A | * | 4/1992 | Becker | 482/104 |
| 5,162,031 | A | | 11/1992 | Watson | |
| 5,316,535 | A | * | 5/1994 | Bradbury | 482/135 |
| 5,468,203 | A | * | 11/1995 | Okonkwo | 482/104 |
| 5,667,460 | A | * | 9/1997 | Smith | 482/94 |
| 5,669,859 | A | * | 9/1997 | Liggett et al. | 482/94 |
| 5,716,306 | A | * | 2/1998 | Gallay | 482/104 |
| 5,738,615 | A | * | 4/1998 | McCollum et al. | 482/908 |
| 5,738,617 | A | | 4/1998 | Watson | |
| 6,293,892 | B1 | * | 9/2001 | Slawinski et al. | 482/104 |

FOREIGN PATENT DOCUMENTS

| | | | | |
|---|---|---|---|---|
| DE | 2245608 | * | 3/1974 | 482/133 |
| DE | 3300073 | * | 7/1984 | 482/98 |
| SU | 1085602 | * | 4/1984 | 482/106 |

OTHER PUBLICATIONS

Wilson, GJ et al., The Optimal Training Load for the Development of Dynamic Athletic Performance, Medicine and Science in Sports and Exercise, Official Journal of the American College of Sports Medicine, vol. 25, No. 11, pp. 1279–1286, 1993.*

Wilson, GJ et al., Stretch Shorten Cycle Performance: Detrimental Effects of Not Equating the Natural and Movement Frequencies, Research Quarterly for Exercise and Sport, vol. 67, No. 4, pp. 373–379, Dec. 1996.*

Walshe, AD et al., Stretch–shorten Cycle Compared with Isometric Preload: Contributions to Enhanced Muscular Performance, J. Appl. Physiol., 84(1): 97–106, 1998.*

Newton, et al, Kinematics, Kinetics and Muscle Activation During Explosive Upper Body Movements, *J. Appl. Biomech.*, 1996, 12: 31–41.

* cited by examiner

*Primary Examiner*—Jerome W. Donnelly
*Assistant Examiner*—Victor Hwang

(57) ABSTRACT

This is an automatic locking exercise device that incorporates a one-way locking mechanism. The device includes a frame, which supports a track, preferably a pair of linear bearing rods one on each side. A guide member, or linear bearing runs on each bearing rod and is attached to a handle or bar that is grasped by a user. A one-way lock is used to provide movement of the bar along the track in an upward direction but opposes movement down. In the preferred embodiment, rotating the bar actuates a lock release. This disengages the one-way lock and enables the bar to move freely up and down along the track. If the user ever drops the weight the one-way lock automatically engages and catches the weight. Explosive power training can also be performed on the device in that the user can safely throw the weight, knowing that the weight will be automatically caught at its highest point without risk of injuring someone. Marking the highest point allows the user to quantify their explosive training performance and progress.

35 Claims, 13 Drawing Sheets

AUTOMATIC LOCKING EXERCISE DEVICE AND METHOD

BACKGROUND OF THE INVENTION

The invention herein relates to exercise devices and more particularly to an exercise device with an automatic locking feature that allows for explosive power training.

Exercise devices have a singular function, which is to stress the body in a controlled manner. This control provides an element of safety that is intended to prevent injury. In some cases this "control" takes away from the function of the exercises performed on the device. When properly designed, an exercise device allows additional features that are not possible or feasible do to safely of the user or the surroundings. Many restricted motion, such as linear motion, exercise devices fall under one or both categories.

Exercise devices that follow a track are typically linear in nature, but can be curvilinear or arcuate. They are generally supported on a frame and have a bar or carriage that is attached to linear bearings or wheels. These bearings or wheels run on a rod or in tracks, which are supported by the frame. Typically, movement is restricted to a single degree of freedom, as is the case with a linear motion device. These devices can be potentially limiting, in the case of mimicking a movement that is not typically linear in nature. A bicep curl for example would not be an easily adapted exercise to a linear device, but a back squat would, in that the bar moves in a substantially linear motion anyway.

Since the movement is restricted by the track and frame, if the user fatigues to a point that they are put in danger of being injured by the weight falling on them, some method of catching the weight can be employed. Unfortunately in most products this is limited to two or more catches in which the user must move some lever or rotate the bar and find the hook at the same time. Though better than nothing, doing a bench press and realizing you do not have the ability to stop the weight before it hits your chest, looking for a lever and a hook a fraction of a second before you are trapped, is far from optimal. In addition, if the weight slips from your grip, or the weight must be dropped due to an injury, the "finding a hook" process is not an option since your hands may no longer be on the bar or handle.

Research has given evidence to support the adage "train as you perform". Many athletes rely on explosive power production (work done over time) to optimally perform their athletic events. Jumpers, throwers, sprinters or any other use of rapid acceleration of their body or another object, is a power athlete. Newton and colleagues, at Southern Cross University in Lismore, Australia (*J. Appl. Biomech.,* 1996, 12: 31–41) found a greater velocity of movement, force production and muscle activation in subjects that were allowed to release the bar at the end of a bench press movement versus the same movement with the exception that the users held on to the bar at the end of the movement. The "throwing" movement is consistent with what is seen in sport and also lends itself to consistent neuro-muscular adaptation, which is another positive training feature. Without a specific device, the risks to such a method of training are obvious. Throwing a weighted bar is dangerous to the user and anything in the vicinity when the bar comes back down. Also it is difficult, if not impossible, to gauge the performance of such throws or in this case to mark the height of the throw. Though a linear, or restricted, motion device was used in this study, it has been expressed to the applicant that such a device was specifically modified for use in this study. It included an electromagnetic brake that was actuated manually by the test administrator or by the sensing devices and controlled by a microprocessor.

Few if any real attempts have been made to enable such training or providing a device which allows a safer method of general physical training. Hibler, Jr. et al (U.S. Pat. No. 4,549,734) discloses a leg press device that includes a seat pad position locking device which has a rail with slots cut therein and a pivoting handle with angular placed "dogs" secured thereto. This "ratcheting" device is used specifically as a seat adjustment. It is not associated with the carriage where the weight is positioned and therefore has nothing to do with securing the weight.

SUMMARY OF THE INVENTION

Present Invention:

In one aspect, the invention features a frame with a load rack and a track. The track is typically a linear bearing rod or a channel, which may be substantially linear, curvilinear or arcuate. A bearing member, such as a linear bearing, bushing or a wheel, is used in communication with the track. The bearing member is attached to a handle, such as a longitudinal bar. The device also includes a one-way locking mechanism. This lock includes a counterbalanced eccentric pin, which is secured to the handle. The eccentric pin provides contact with the load rack while in an unattended state and detachment from the load rack when the handle is rotated. The counterbalanced of the eccentric pin is either due to the force of gravity acting on the pin, thereby applying a force to move a pin tip into contact with the load rack, by use of a spring or both.

The system may also include a load rack that is comprised of a notched rack, preferably a saw-tooth notched rack, or a pressure plate. The pressure plate includes a substantially flat plate with a relatively high coefficient of static friction between an outer surface and a contact surface of the eccentric pin. Additional features include the load rack being movably mounted to said frame and a rack spring that at least partially supports the load rack on the frame.

In another aspects, the invention includes a method of providing an exercise device, which includes moving the handle upward, by a user, in a forceful manner and releasing the handle from contact with the user and then allowing the locking device to secure the handle when the handle is free from contact with the user. This allows the user to perform explosive movements by throwing the weight. It also allows the user to drop the weight without risk of injury.

Definition of Terms:

Unless otherwise defined, all technical and scientific terms used herein have the same intended meaning as would be commonly understood by anyone of ordinary skill in the art to which this invention belongs. To eliminate possible ambiguity, specific terms used herein have been defined, as they would be applied to the present invention.

The term "curvilinear" relates to any thing having a shape of a curved line, or any portion of or combination of curved lines. For example the shape of an "S" is curvilinear in that it includes a combination of curved lines and straight lines.

The term "arcuate" relates to any thing having an arced shape, which includes a bend or curve in the form of a bow. This may be a single formed curve that is made up of a variety of small curves of various radii that are all joined together end to end.

The term "linear" relates to any thing that is straight, not being curvilinear or arcuate. "Substantially linear" is considered to include structures that are linear within reasonable manufacturing processes.

The term "compression spring" includes any form of bumper or coiled spring. This includes natural and synthetic rubber bumper stops, coiled springs, Belleville spring washers, curved spring washers, wave spring washers and gas springs.

The term "eccentric pin" will be used as a generic term to include both the terms "cam" and "pawl". These terms are both used in this application to designate an eccentrically shaped device that articulates with a rack or plate to lock one to the other in one direction but allows free movement in the opposite direction. The term "cam" is typically used in relation to a friction lock and "pawl" is used in conjunction with a toothed rack.

DETAILED DESCRIPTION OF THE PREFERRED EMBODIMENT

The object of the disclosed invention is to provide an improved device and method of moving a weighted handle or bar for physical exercise. The device includes an automatic one-way locking mechanism that is engaged unless intentionally disengaged by the user. The lock allows for upward movement but not downward movement unless the lock is disengaged. When the user is not in contact with the handle or bar of the device, the locking mechanism is engaged.

Figure 1:
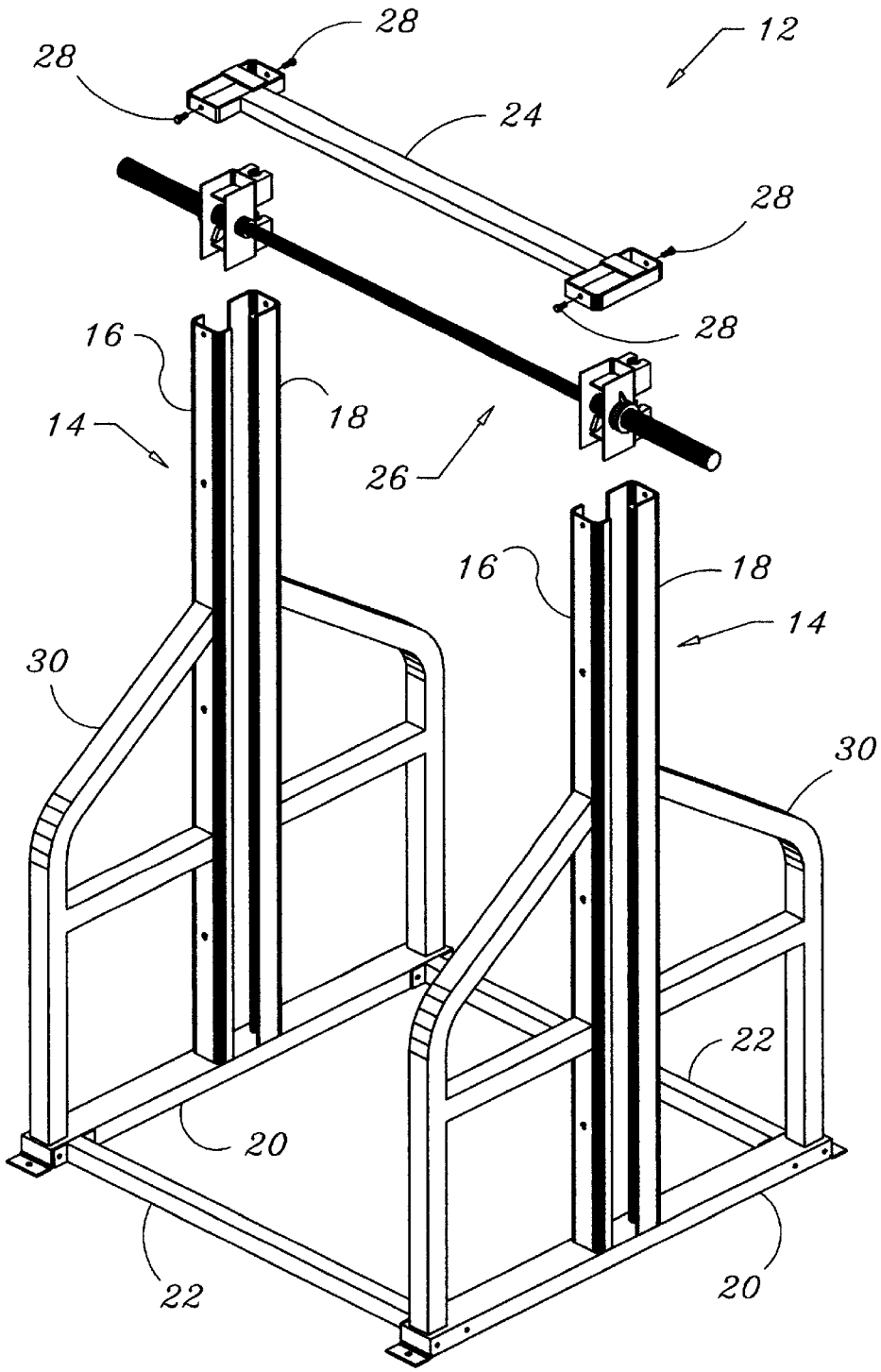
FIG. 1 is an isometric, exploded view of a linear motion exercise device produced in accordance with a preferred embodiment of the present invention.

What is shown in FIG. 1 is an isometric view of an automatic locking exercise device 12. The device includes two towers 14. Each tower 14 is comprised of a rear rail 16 and a front rail 18, one on each base frame 20. The base frames 20 are connected by cross frames 22 in the front and rear of the device. A top brace 24 is used to support the upper ends of the towers 14 as well as to capture the locking bar 26 within the framework of the device, when assembled for use. Fasteners 28 are used to secure the top brace 24 to the upper ends of the rear rails 16 and the front rails 18 of each tower 14. The structure of the top brace 24 maintains the proper distance between each tower 14 as well as the proper distance between the upper ends of the rear rail 16 and the front rail 18 of each tower 14. Side braces 30 are also used to maintain the distance between the rear rail 16 and the front rail 18 of each tower 14 at intervals along the span of each tower 14. What is shown here is one example of a design, but the details of this structural design are not considered critical to the novelty of the invention.

Figure 2:
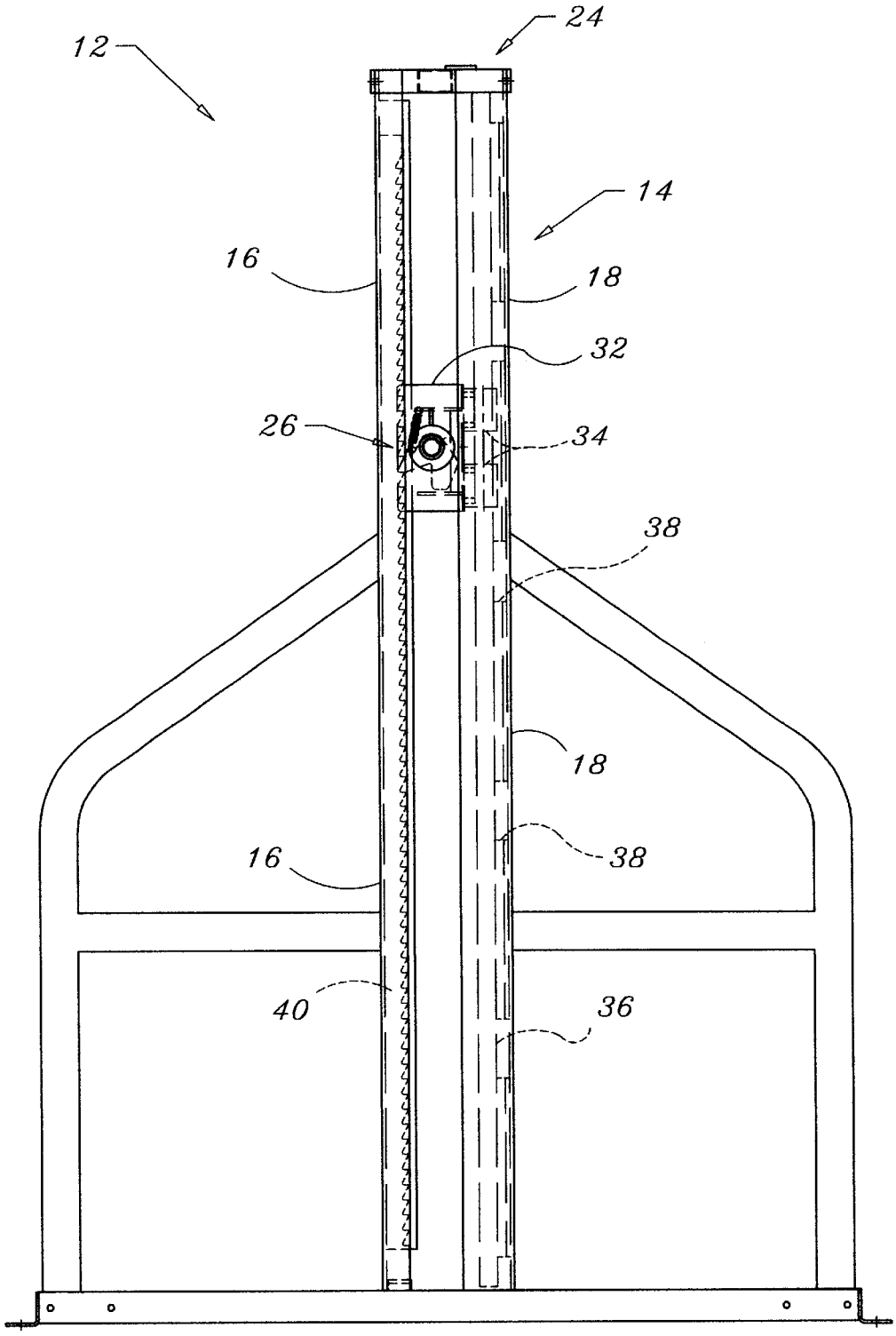
FIG. 2 is a side view of an assembled linear motion exercise device showing the relevant hidden lines, the device produced in accordance with a preferred embodiment of the present invention.

A side view of the device is shown in FIG. 2. Here the rear rail 16 and the front rail 18 that make up the tower 14 are shown in more detail. The collar frame 32 portion of the locking bar 26 is supported to frame of the device 12 by use of the linear bearings 34. Linear bearings are the preferred method for a linear system, but a bushing can also be used. The top brace 24, shown here as mounted to the upper end of the towers 14, completes the assembly of the device 12. The hidden lines show more detail of the bearing rod 36 as being supported by a series of rod supports 38 which in turn are secured to the front rail 18. On the opposite side of the tower 14, a rack 40 is mounted to the rear rail 16. More detail to this arrangement is shown in the figures that follow.

Figure 3:
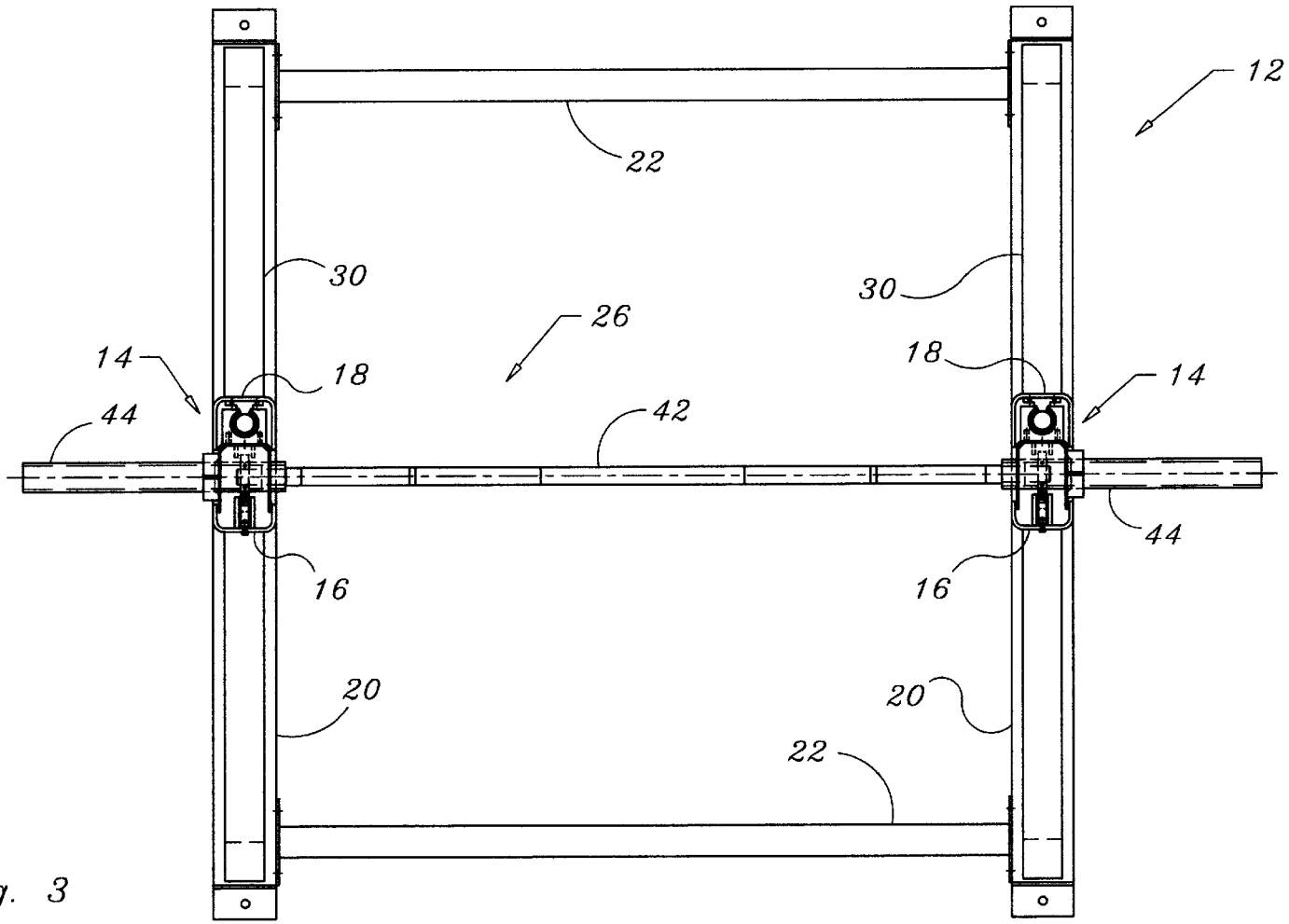
FIG. 3 is a top view of a linear motion exercise device, shown with the top brace removed, the device produced in accordance with a preferred embodiment of the present invention.

Another overview is shown in FIG. 3. This is a top view of the device 12. The top brace 24 has been removed to show more detail of the device 12. The side braces 30 supported on the base frames 20 which are in turn held together by the cross frames 22. Each tower 14 receives a portion of the locking bar 26. The locking bar 26 is comprised of a substantially longitudinal bar 42 preferably with a collar 44 on each distal end. The collar 44 is used to support weight plates. Generally circular in shape, the collar 44 is preferably a cylindrical tube that is made to fit standard weight plates. The rear rails 16 and the front rails 18 of the towers 14 house the locking mechanism of the locking bar 26 as well as guide it in a predetermined path of travel, in this case a linear vertical movement.

Figure 4:
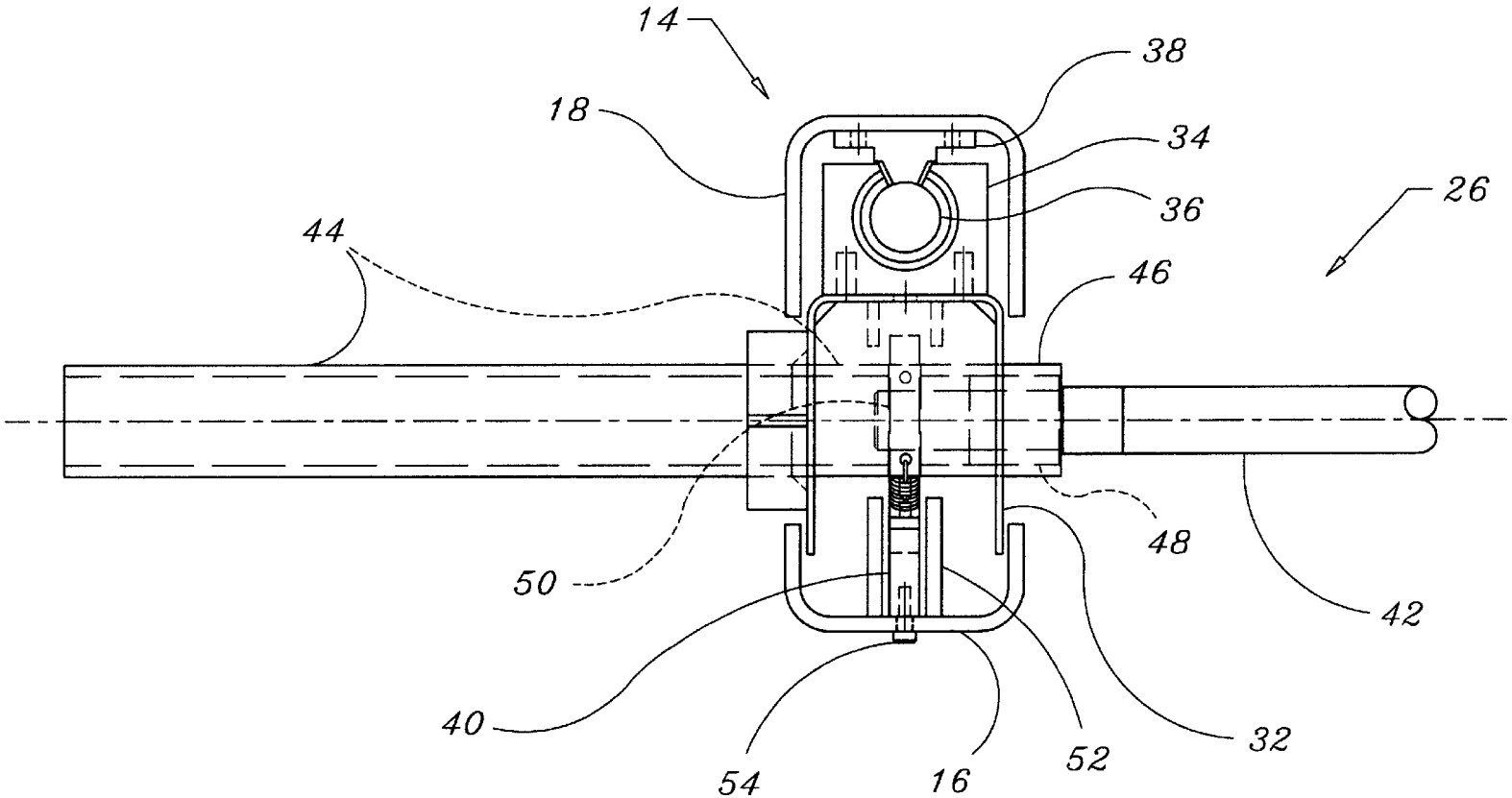
FIG. 4 is a fragmented top view of the left portion of the bar and locking mechanism of a linear motion exercise device produced in accordance with a preferred embodiment of the present invention.

A more detailed view of the left portion of the locking bar 26 and a tower 14 is shown in FIG. 4. The rest of the frame is not shown for illustrative purposes. The collar frame 32 provides a structure that supports the collar 44. The collar frame also supports the medial collar 46 which receives the bar 42. The bar 42 is free to move within the medial collar 46 and is preferably assisted by a bushing 48. There is a gap between the inside edge of the collar 44 and the outside of the medial collar 46. This gap allows for an eccentric pin or in this case a pawl 50, which is then secured to the bar 42. By securing this pawl 50 to the bar 42 between the collar 44 and the medial collar 46, this secures the bar 42 relative to the collar frame 32 and allows remote articulation of the pawl 50 by rotation of the bar 42. The front rail 18 supports the rod supports 38, which support the bearing rod 36. The bearing members, or in this case linear bearings 34, are fastened to one side of the collar frame 32, thus providing guided tracking of the locking bar 26 along the bearing rod 36.

The pawl 50 is positioned to enable communication with the rack 40, which is fastened to the rear rail 16. Additional guides 52 are positioned on either side of the rack 40 and the pawl 50 to ensure communication between the pawl 50 and the rack 40 as well as to provide additional structural support to the rear rail 16. In the preferred embodiment the rack 40 is secured to the rear rail 16 in a movable manner. In this case the rack 40 is secured by shoulder screws 54, which pass through slots in the rear rail 16. This allows the rack 40 to move slightly in a vertical direction with respect to the rear rail 16. This movement will be later shown to be beneficial in the reduction of the peak forces during the impulse, which is experienced when the pawl 50 contacts the rack 40 under heavily loaded conditions.

Figure 5B:
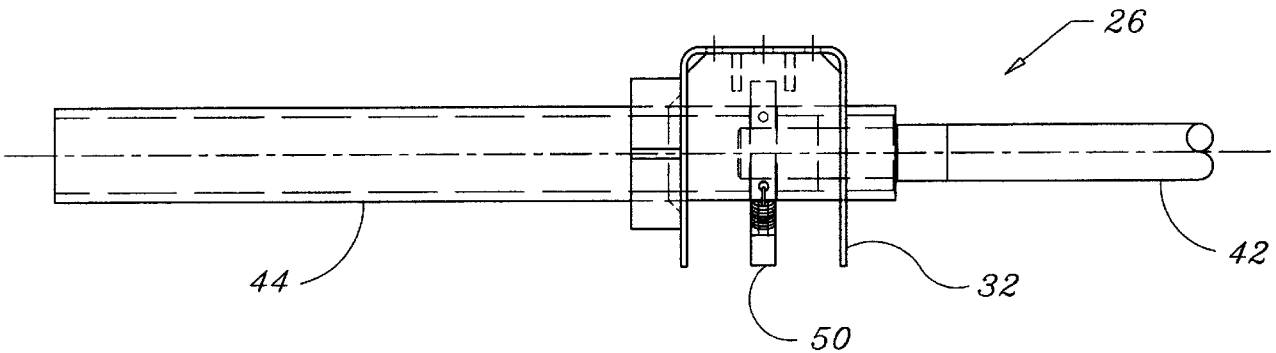
FIGS. 5*a* and 5*b* are fragmented top and front view of the left portion of the bar and collar frame of a linear motion exercise device produced in accordance with a preferred embodiment of the present invention.
Figure 5A:
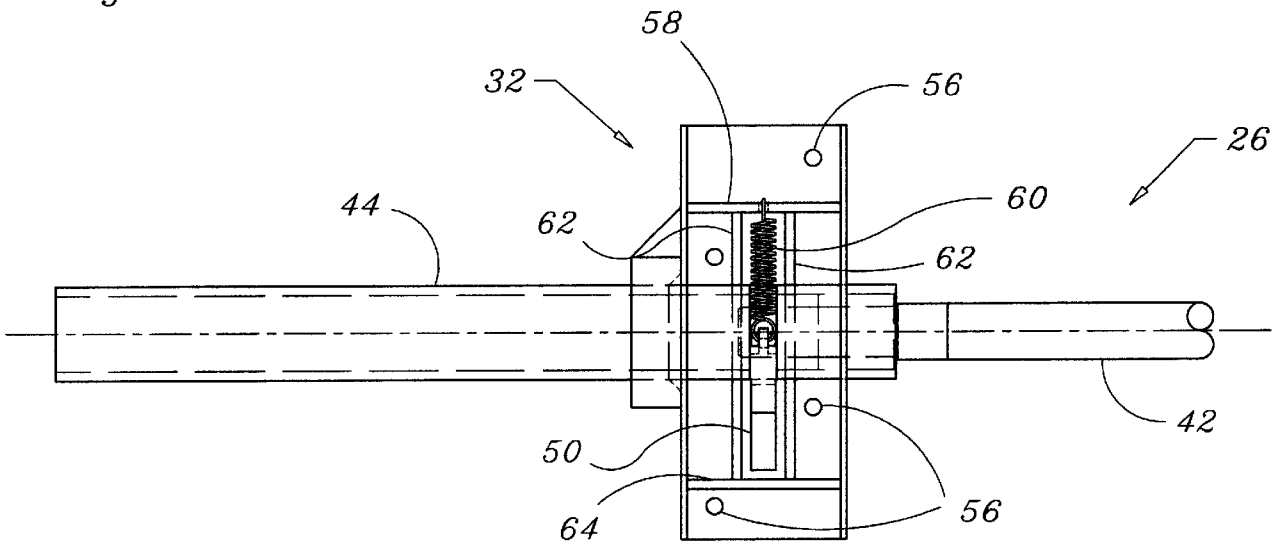

Front and top views of a fragmented portion of the locking bar 26 and the collar frame 32, with the pawl 50, are shown in FIG. 5. The bar 42, collar 44 and collar frame 32 are as previously disclosed. The front view of the collar frame 32 shows more detail of the structure and function. As in the previous figure, the linear bearings were mounted to the collar frame 32. This can be accomplished by any number of methods but a very functional method is, as shown here, by using several mounting holes 56. To increase structural integrity, a series of bars are added. A top bar 58 connects the sides of the collar frame 32 on the inside of the structure. The placement of the top bar 58 is desirable in that it also has the function of supporting a pin spring 60. The pin spring 60 is a form of a counterbalance that is preferred, in that it not only adds to the rotational torque used to rotate the pawl 50, but it acts as a bias and damps vibration that can be experienced under extreme conditions of use of the device. The spring 60 is not necessary, but in many cases desirable. Additional sidebars 62 and lower bar 64 are also added to increase the structural integrity of the collar frame 32. These bars are not considered necessary to the novelty of the invention but are added in that they are part of the preferred embodiment.

Figure 6:
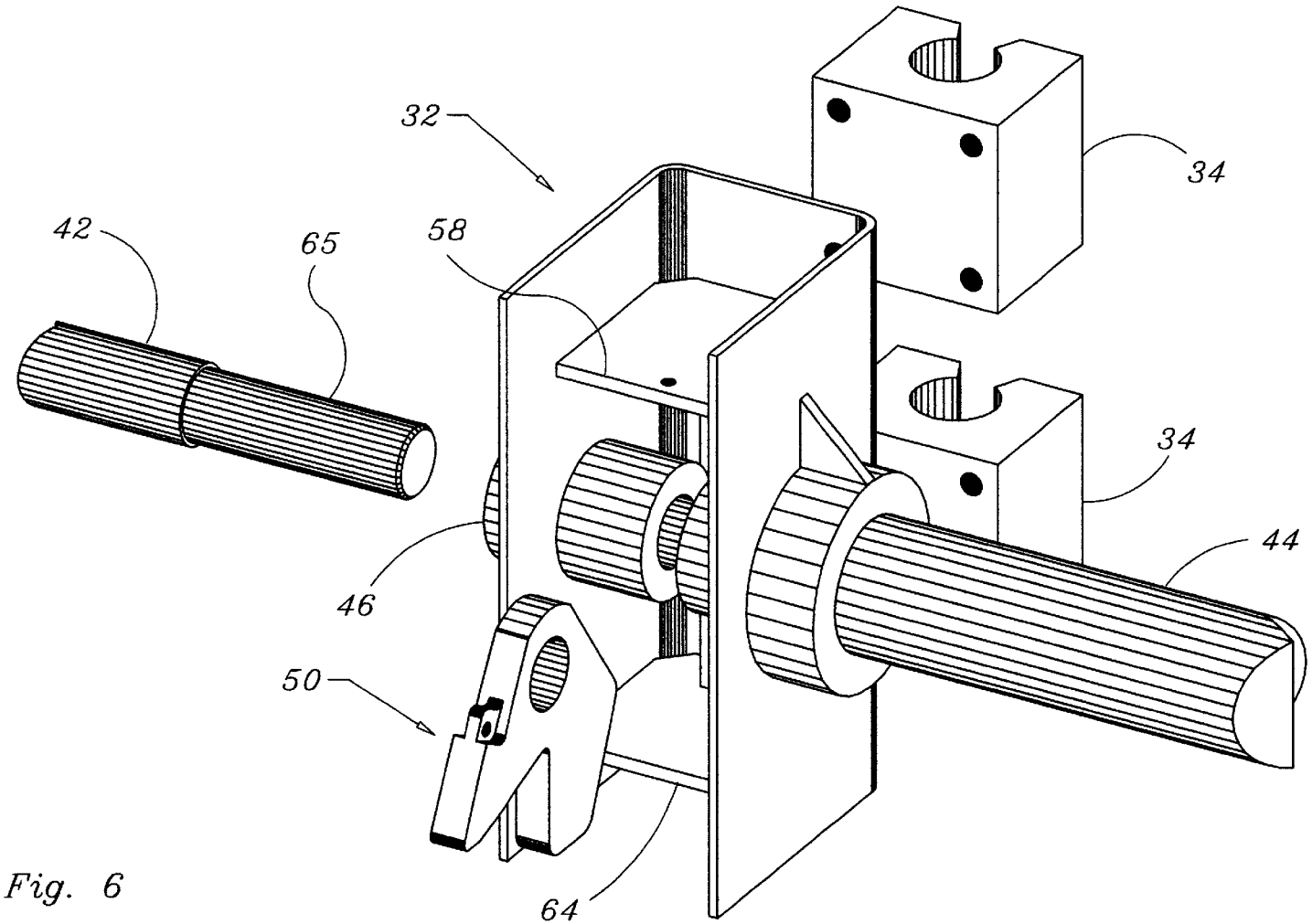
FIG. 6 is an exploded isometric view of a locking mechanism, including the locking pin and collar frame the device produced in accordance with a preferred embodiment of the present invention.

An exploded isometric, fragmented view of the collar is shown in FIG. 6. This explicitly shows the construction of the device in the preferred embodiment, but without the pin spring. The locking pin or pawl 50 has been removed from the space between the medial collar 46 and the collar 44 and also between the top bar 58 and the lower bar 64 of the collar frame 32. Both the medial collar 46 and the collar 44 are secured to the walls of the collar frame 32 and thereby provide support for the turned end 65 of the bar 42 when it is inserted in the medial collar 46. The turned end 65 is fastened to the pawl 50, in the assembled position, to enable movement of the pawl by rotation of the bar 42. The linear bearings 34 are also shown in their relative positions, though removed from the collar frame 32.

Figure 7B:
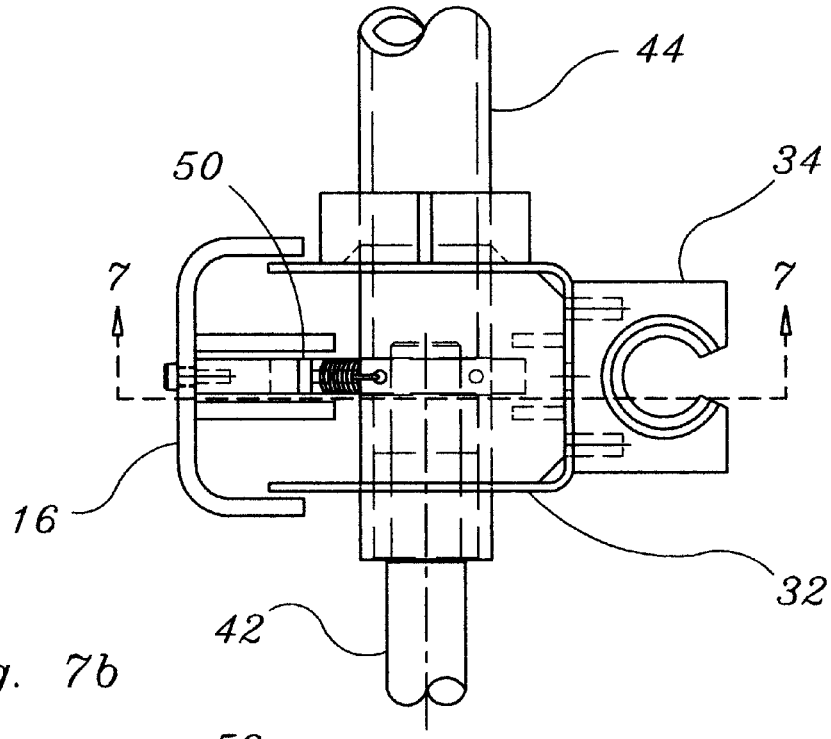
FIGS. 7*a* and 7*b* are side and associated top view, with section line 7—7, of the locking mechanism in a locked position of a linear motion exercise device, the device produced in accordance with a preferred embodiment of the present invention.
Figure 7A:
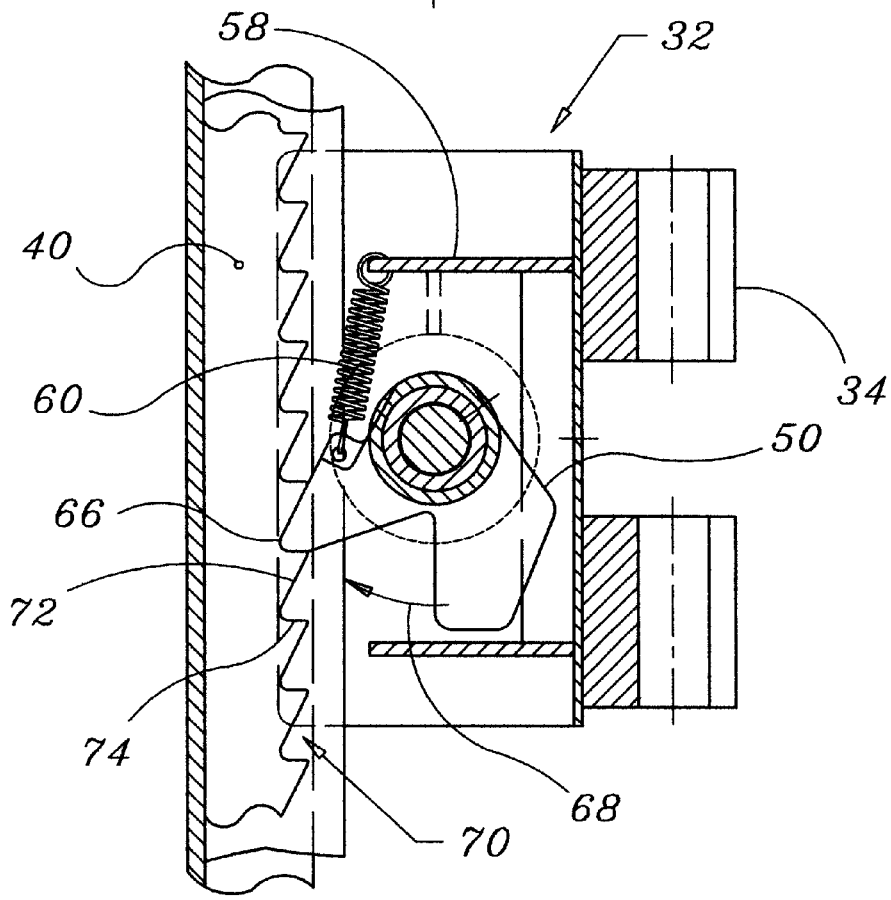

A detail of the locking mechanism is shown in FIG. 7. The top view shows a section line 6—6 to which this sectioned view is shown in the front view. In this figure the system is locked in that the pawl 50 is in contact with the rack 40. Here the counterbalance of the pawl 50 is two fold. First, the center of gravity of the pawl 50 is positioned such that the force of gravity acting on the pawl 50, when supported by the bar 42, applies a force to move a pin tip or pawl tip 66 of the eccentric pin or pawl 50 into contact with the rack 40. The second aspect is that of the pin spring 60, which in this case is a tension spring, applies a moment that also rotates the pawl tip 66 toward the rack 40, as depicted by the arrow 68.

As can be seen, the rack 40 includes a plurality of teeth that are saw-tooth notches 70. These notches 70 include a sloped portion 72 and a load-bearing portion 74. The sloped portion 72 provides a transition to allow the pawl 50 to move upward as the pawl tip 66 would index from one load-bearing portion 74 to the next higher load-bearing portion 74. The pawl 50 cannot move down the rack 40 unless the pawl 50 is rotated clear of the rack 40. This is one method of providing a one-way lock that is desirable to such a device. In this way the weighted locking bar can be moved up the rack 40 and be released from contact by the user. The locking bar is free to move up but not down, when locked, thereby providing a safety feature to the user and allowing for explosive movements for the locking bar and associated weights to be thrown. The locking bar then secures the bar at the uppermost position. In addition to safety, this gives the user quantification as to the power production of that particular lift.

Figure 8B:
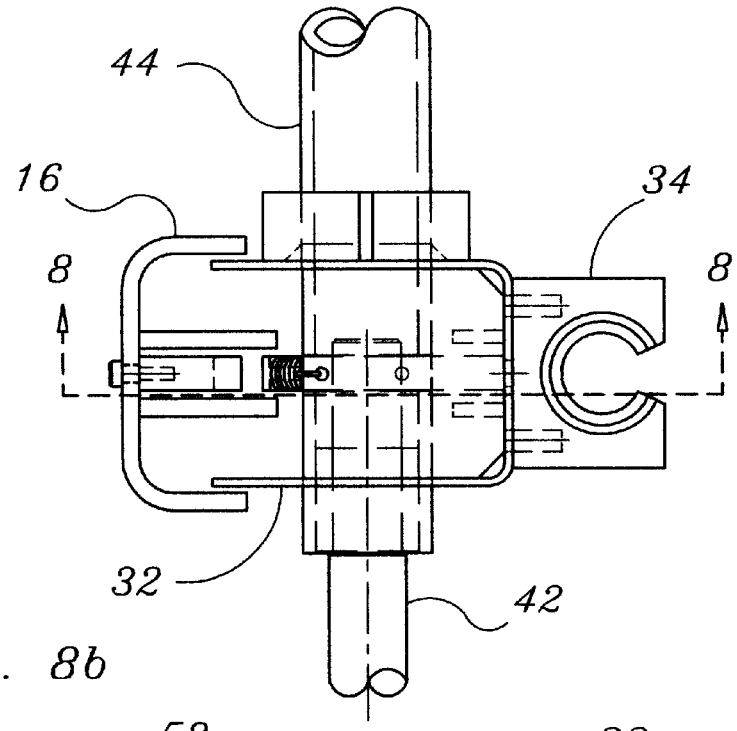
FIGS. 8*a* and 8*b* are side and associated top view, with section line 8—8, of the locking mechanism in an unlocked position of a linear motion exercise device, the device produced in accordance with a preferred embodiment of the present invention.
Figure 8A:
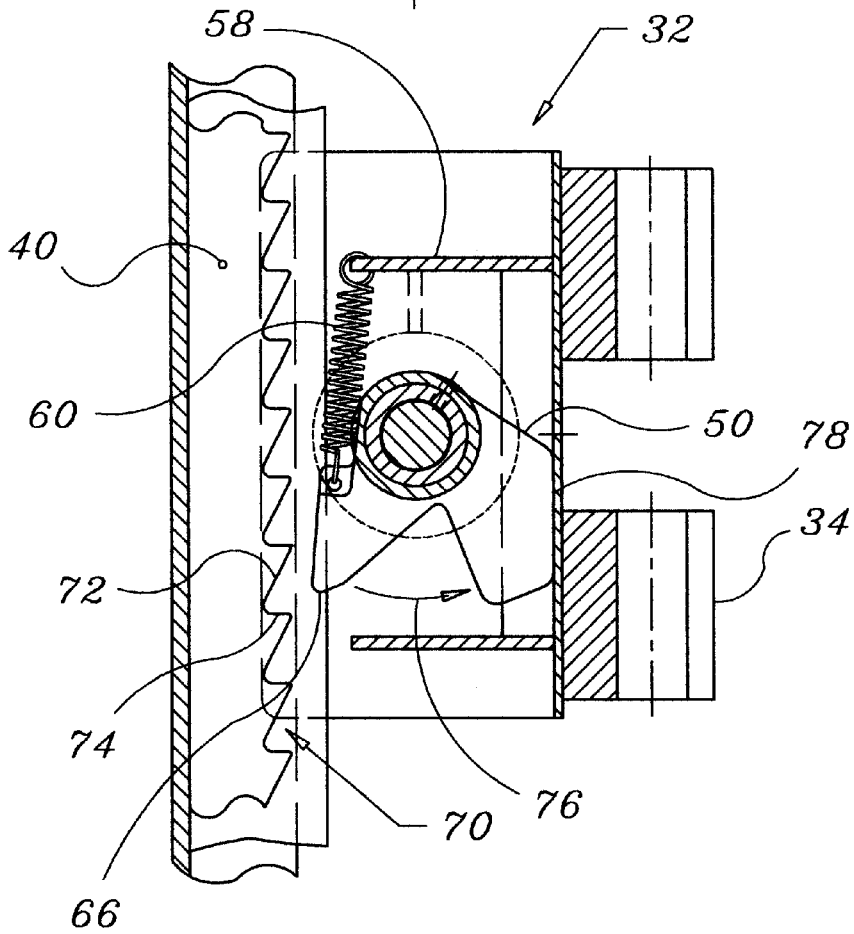

The one-way locking mechanism is shown in FIG. 8 in an unlocked position. As with the previous figure, the top view includes a section line 8—8 to which the sectioned view is shown in the front view. To unlock the system, the bar 42 is rotated counterclockwise, in this view, as depicted by the arrow 76. Here a built in stop exists by a pawl leg 78 contacting the back of the collar frame 32. To maintain the lock in this position, the bar 42 must be forcibly maintained in this rotated position. If the bar 42 is released, the forces of gravity acting on the pawl 50 and the force of the pin spring 60 rotate the pawl tip 66 into contact with the rack 40. In this unlocked position the collar frame 32 and the rest of the locking bar can freely move both up and down along the guidance of the bearings 34. Repetitive exercise movements can then be performed and in the case that the bar 42 is released from contact with the user, the one-way locking mechanism will automatically engage.

Figure 9:
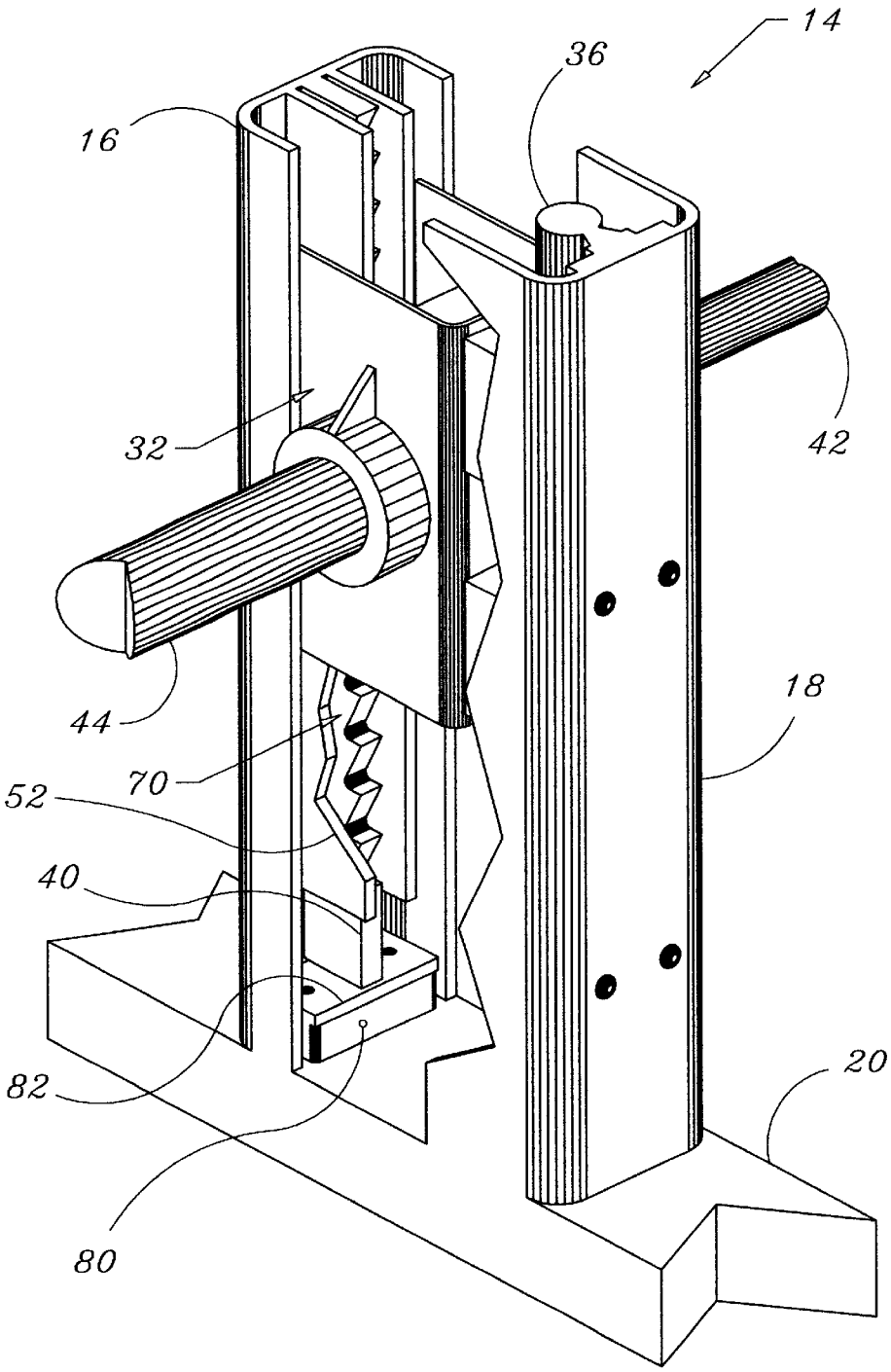
FIG. 9 is an isometric fragmented view of the bar and locking mechanism showing the rack cushion near the base of the frame of a linear motion exercise device produced in accordance with the preferred embodiment of the present invention.

A fragmented isometric view of a lower section of one tower 14 is shown in FIG. 9. Sections of the front rail 18 and one guide 52 are removed, thereby making the detail more visible. The collar frame 32 supports the collar 44 and the bar 42 as previously disclosed. The lower portion of the front rail 18 and rear rail 16 that comprise a tower 14 are mounted on the base frame 20. As previously disclosed, since the rack 40 is a load bearing structure, the force transmitted through the pawl when locked, it is in may ways desirable to allow the rack 40 to move, reducing the acceleration of the weighted bar on the rack 40. This decreases the amplitude of the impulse and associated loads. This dampening is accomplished by positioning a cushion or rack spring 80 under the rack 40. This enables the rack spring 80 to at least partially support the rack 40 on the frame, in this case the base frame 20. The rack spring 80 is shown here to be in the form of a compression spring or bumper pad. Suitable materials and forms of such a compression spring are numerous. Some variations in suitable types of compression springs have been defined herein. Materials for such a spring 80 include plastic, metal, natural rubber and synthetic rubber. The preferred embodiment of this spring 80 is polyurethane (synthetic rubber) of a durometer between 80 A and 95 A. The rack spring 80 is preferably fastened to a plate 82 that is fixed to the bottom of the rack 40. This is only one method of providing this impact-absorbing feature. The spring could also be in the form of a tension spring, which supports the rack 40 from above on the upper portion of the frame.

Figure 10:
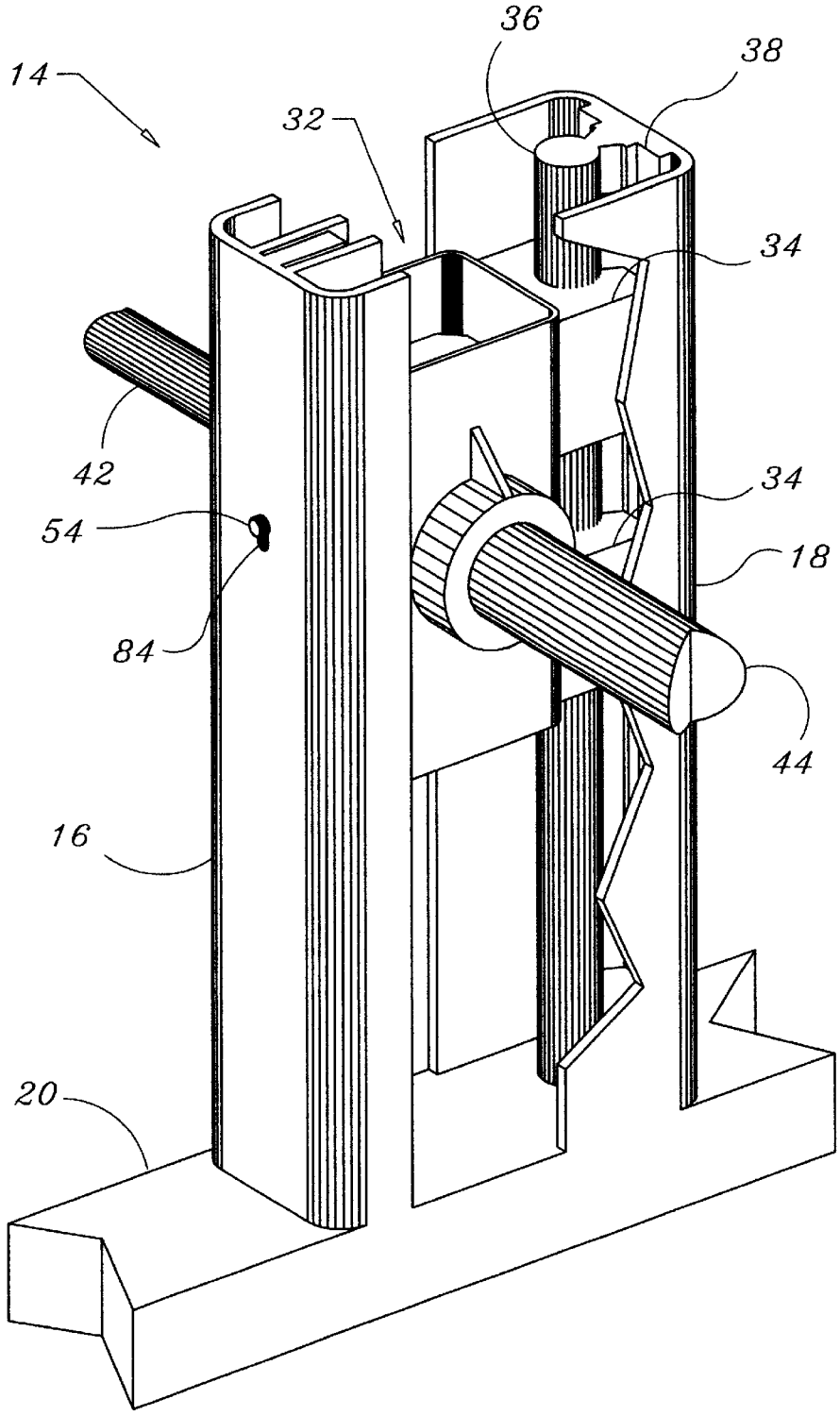
FIG. 10 is an isometric fragmented view of the bar and locking mechanism showing the bearings and bearing rod near the base of the frame of a linear motion exercise device produced in accordance with the preferred embodiment of the present invention.

In FIG. 10, more detail is shown. Here the fragmented lower section of one tower 14 is viewed from another angle. The shoulder screw 54 that mounts the rack 40 to the rear rail 16 is shown as the shaft of the screw 54 passes through the slot 84 cut in the rear rail 16. This allows a restricted amount of vertical movement of the rack 40 with respect to the rear rail 16. This view also shows the rod supports 38 supporting the bearing rod 36 which provide the guidance for movement by the linear bearings 34.

Figure 11:
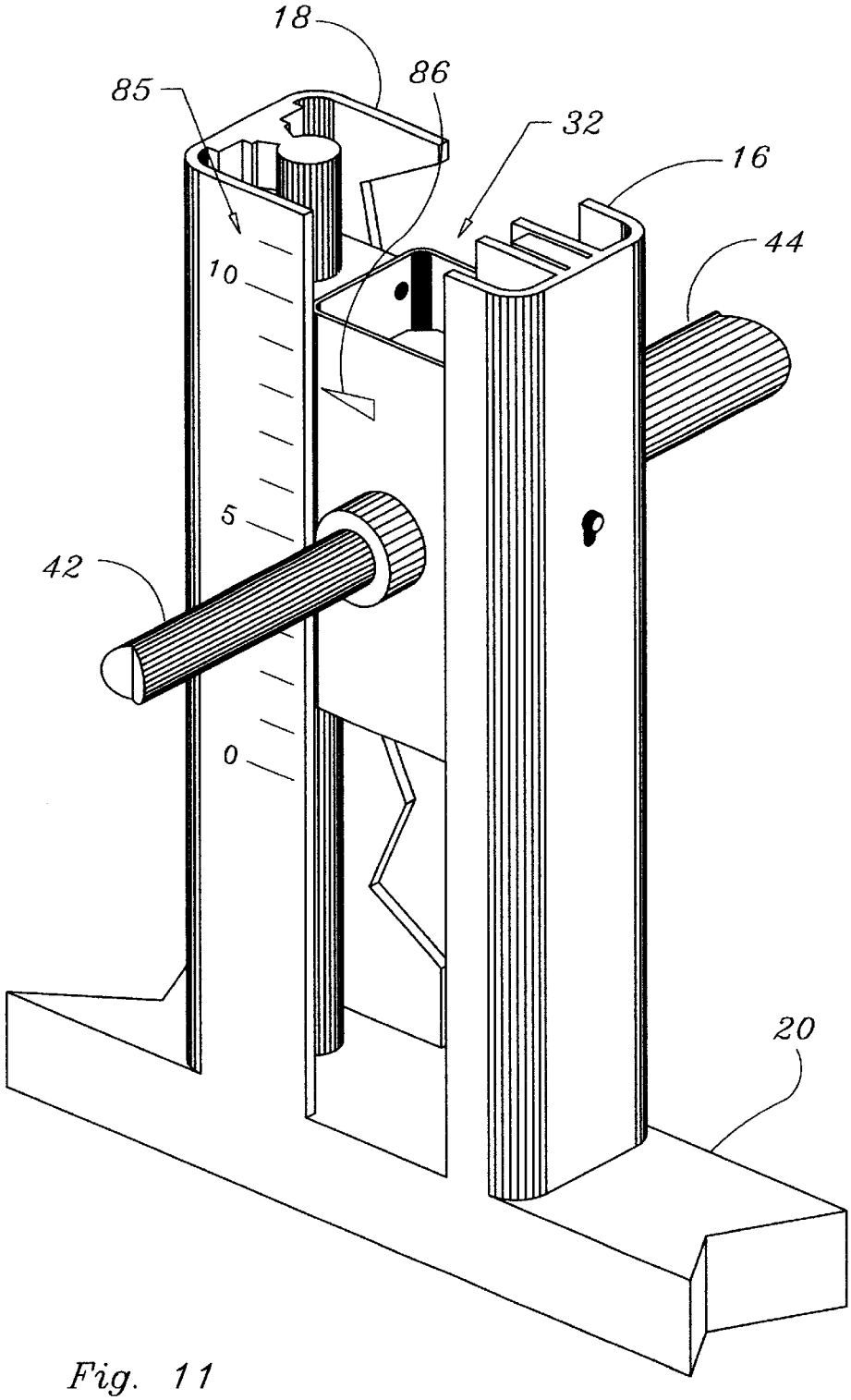
FIG. 11 is isometric fragmented view of the bar and locking mechanism as viewed from the inside looking out and showing a detail of an indexing marker, the device produced in accordance with the preferred embodiment of the present invention.

Another useful aspect of the device in this arrangement, is in the use of a method of quantifying the performance of a user by use of an indexing device. In FIG. 11 an isometric fragmented view of a lower portion of one tower is shown. In this view the inside of the tower is shown. The bar 42 extends toward the viewer, and the user, and the collar 44 is on the outside. The indexing device is comprised of a series of increments 85 are marked in the inside of the front rail 18. The increments 85 may be marked in accordance with the increments of the rack, if a toothed rack is used, or in any other increments. Increments of inches are used here. A marker 86 is located on the collar frame 32 as an indicator as to the relative position of the collar frame 32, and therefore the bar 42, to which the user moves during exercise. In this way the user can move or throw the bar 42 and associated collar frame 32, and collar 44 with weight plates, using the one-way locking device to secure this combination at its highest point after release. In this way the user can quantify the performance of their training. The user may also simply use it as an indicator as to the relative height of the bar, or distance traveled, during repetitive lifting.

Figure 12B:
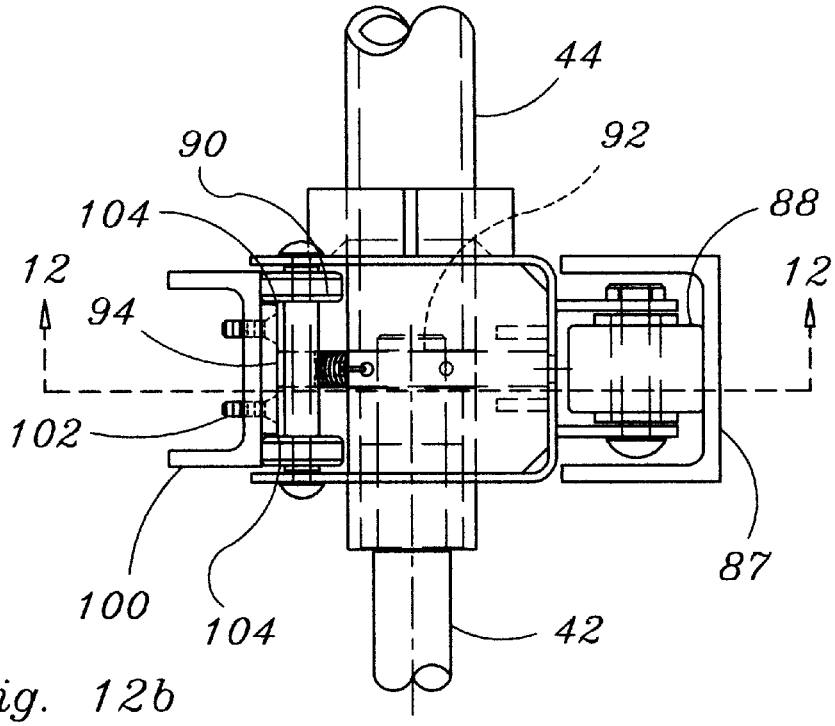
FIGS. 12*a* and 12*b* are side and associated top view, with section line 12—12, showing an alternative locking and guide mechanism of a linear motion exercise device, the locking mechanism in a locked position.
Figure 12A:
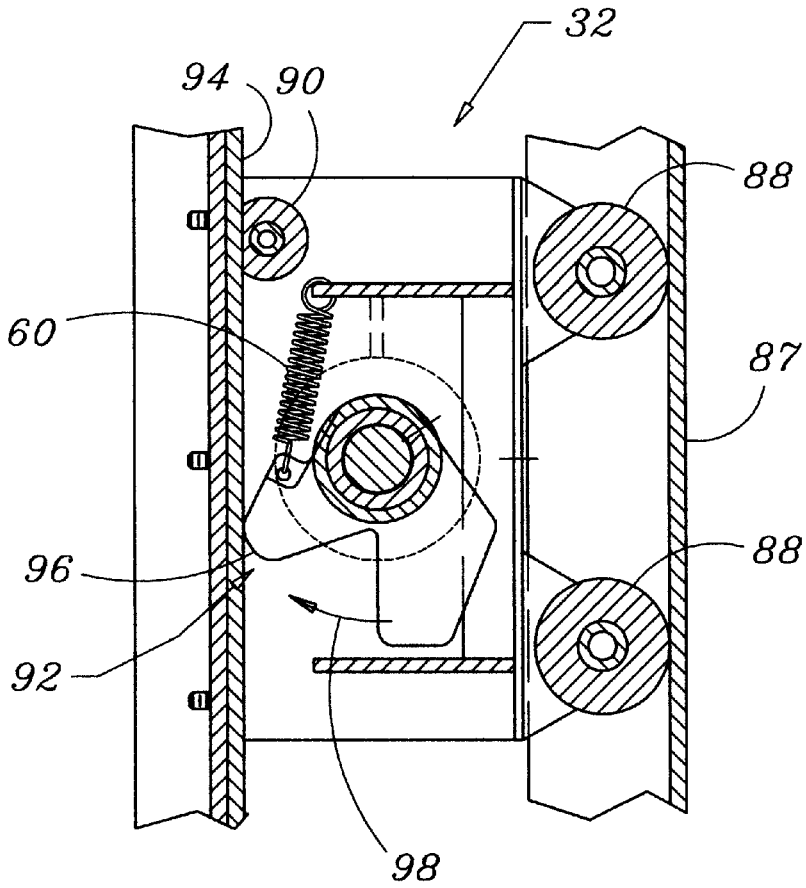

An alternative form of the one-way lock and track are both shown in FIG. 12. Consistent with previously, the top view includes a section line 12—12. The sectioned view is shown in the front view of the same figure. The track, which previously was a bearing rod, has been replaced with a channel 87, which in this instance also doubles as a front rail. The linear bearings or bushings have been replaced with a pair of front wheels 88 that together define a restricted path of travel. What was previously disclosed was a linear system. This is preferable in many instances and for the purposes of this disclosure, it is considered to be the preferred embodiment. However, in some instances specific curvilinear or arcuate paths may be desirable. In that case the track can be altered to fit an infinite number of shapes. Since linear bearings and bushings are designed to work in a linear mode, such a variation as shown here would be more easily adapted to provide curvilinear or arcuate paths of travel. The channel 87 can be formed to virtually any shape and the three-wheeled structure allows for travel along such a path.

The front wheels are shown here to be larger than the rear wheel 90. This is not a necessary aspect of the invention but is preferable since the rear wheel 90 acts only as a guide and support. The front wheels 88 are required to support a large load when the eccentric pin, now shown in the form of a cam 92 is forced against the load rack, which is now in the form of a pressure plate 94, to activate the one-way lock. The pressure plate 94 is a substantially flat plate with a relatively high coefficient of static friction (greater than 0.5) between an outer surface and a surface of contact with the contact component of the one-way lock. This contact component is a pin tip or cam nose % of the eccentric pin or cam 92. As before, the force to make contact is that of gravity acting on the cam 92 and/or the tension in the pin spring 60. The force of this couple is depicted by the movement of the cam 92 is indicated by the arrow 98. This is an eccentric lock that relies on the frictional force between the cam nose 96 and the pressure plate 94. As such, the coefficient of static friction is important to the enable the lock to work without excessive normal loads that translate to forces that work to push the channel 87 and a rear channel 100 apart from one another. As with the notched rack and pawl system as previously disclosed, this friction based system also allows for vertical (one-way) movement at all times and when locked, precludes movement of the collar frame 32, bar 42 and collar 44 in a downward direction.

The pressure plate 94 is preferably replaceable in that it, like the cam 92, are both wearing parts. The pressure plate 94 can be fastened to the rear channel 100 in any number of ways that are common to the art. Here threaded fasteners 102 are used with a countersunk head so as not to interfere with the contact of the cam 92 and the pressure plate 94. Likewise, the rear wheel 90 is in the shape of a spool so as to use the edges 104 of the pressure plate 94 as a guide for the rear wheel 90. Any number of modifications can be made to provide tracking on the front wheels 88 and the channel 87 as well.

Figure 13B:
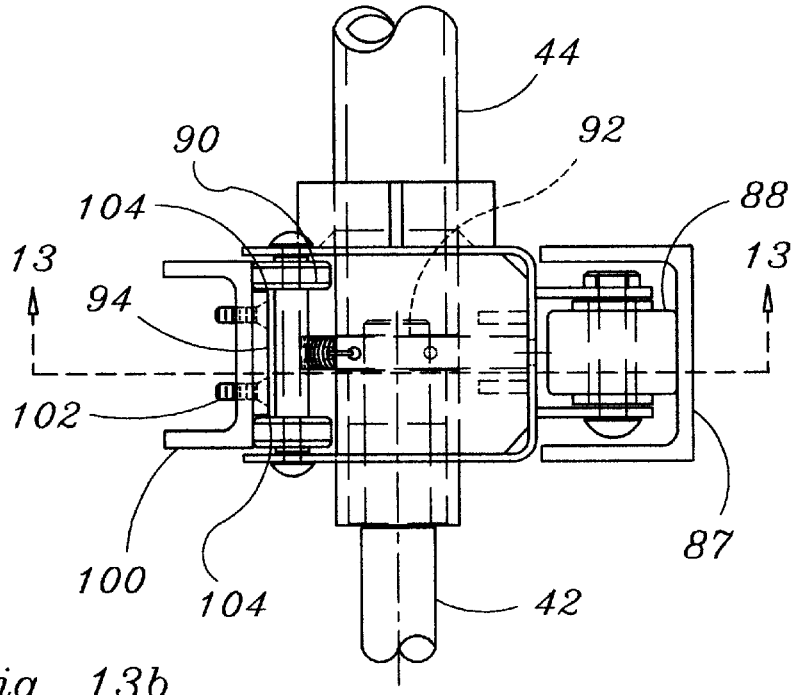
FIGS. 13*a* and 13*b* are side and associated top view, with section line 13—13, showing an alternative locking and guide mechanism of a linear motion exercise device, the locking mechanism in an unlocked position.
Figure 13A:
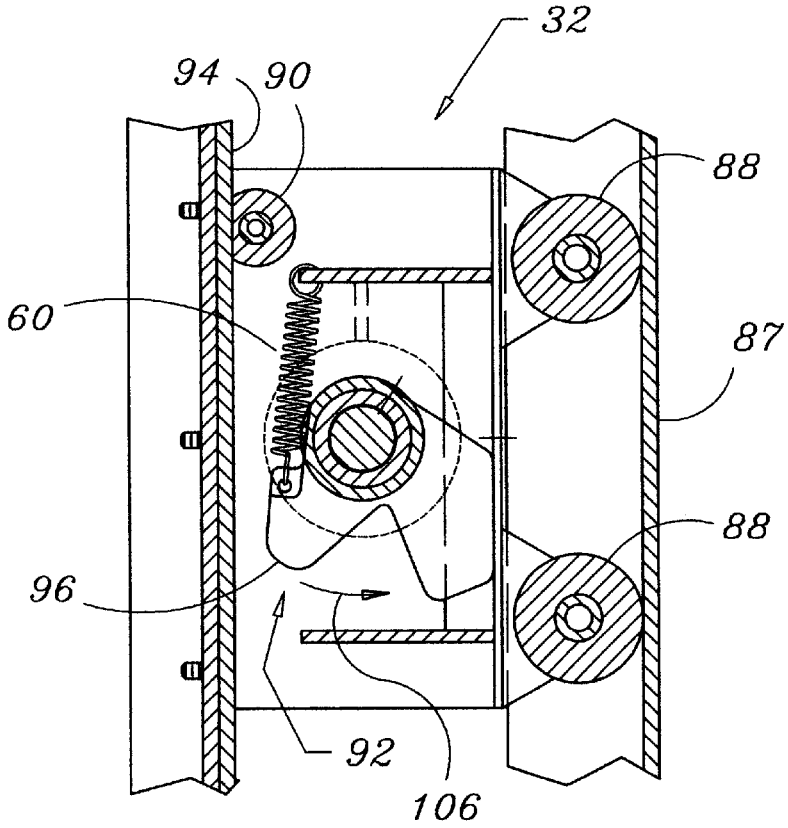

A similar set of drawings are shown in FIG. 13, including the section line 13—13 in the top view and the appropriate sectioned view in the front view, in which case the lock mechanism is in an unlocked condition. The cam nose 96 is shown to be moved away from the pressure plate 94, thus allowing the collar frame 32, bar 42, and collar 44 combination to freely move along the channel 87. The arrow 106 notes the rotation of the blunt nose pawl 92 to place it in an unlocked condition. As before, this is actuated by rotation of the bar 42 by the user and must be maintained in order to remain unlocked.

The rotation of the bar 42 as a release lock is the preferred embodiment in that it is simple to manufacture, maintain and easy to use and understand by the user. Numerous other actuated handles of varying forms could be employed to accomplish this task. It is also considered the preferred embodiment to use of the bar 42 as the handle. In other forms the handle may not be a substantially longitudinal bar, as shown here, but a curved bar or two unique handles that act independent from each other. The pawl can also take many forms. Any device that functions as a ratcheting or eccentric locking cam with a load rack in the form of a notched rack or a pressure plate will function in this capacity.

It is to be understood that all of the enclosed information is presented as the preferred embodiment as seen by the inventor. An infinite number of variations and modifications can be made as the specific application arises.

What is claimed is:

1. An automatic locking exercise device comprising:

a frame including a load rack and a track;

a bearing member supported by said track, the bearing member attached to a rotatable, elongate handle, the handle supporting a collar which is adapted to receive weight plates; and a counterbalanced eccentric pin secured to said handle, the pin providing contact with said load rack while in an unattended state and detached from said load rack by rotation of said handle, said bearing member being upwardly movable relative to said load rack while in the unattended state.

2. The device as described in claim 1, wherein said load rack is a notched rack.

3. The device as described in claim 2, wherein said notched rack is comprised of a plurality of saw-tooth notches with a sloped portion and a load-bearing portion.

4. The device as described in claim 1, wherein said load rack is a pressure plate.

5. The device as described in claim 4, wherein said pressure plate is comprised of a substantially flat plate with a relatively high coefficient of static friction between an outer surface and a contact surface of said eccentric pin.

6. The device as described in claim 5, wherein said coefficient of static friction is greater than 0.5.

7. The device as described in claim 1, wherein said track is a track selected from the group consisting of a linear bearing rod and a channel.

8. The device as described in claim 1, wherein said track is of a shape selected from the group consisting of substantially linear, curvilinear and arcuate.

9. The device as described in claim 1, wherein said bearing member is a device selected from the group consisting of a linear bearing, a bushing and a wheel.

10. The device as described in claim 1, wherein said handle is a substantially longitudinal bar.

11. The device as described in claim 1, wherein said counterbalance is due to the force of gravity acting on said eccentric pin, thereby applying a force to move a pin tip of said eccentric pin into contact with said load rack.

12. The device as described in claim 1, wherein said counterbalance is comprised of a spring.

13. The device as described in claim 12, wherein said spring is an extension spring.

14. The device as described in claim 1, wherein said load rack is movably mounted to said frame, the device further comprising a rack spring that at least partially supports said load rack on said frame.

15. The device as described in claim 14, wherein said rack spring is a compression spring.

16. The device as described in claim 15, wherein said compression spring is a spring manufactured from a material selected from the group consisting of plastic, metal, natural rubber and synthetic rubber.

17. The device as described in claim 14, wherein said rack spring is a polyurethane bumper pad.

18. The device as described in claim 1, further comprising an indexing device that enables quantifying a position of said handle.

19. An explosive power physical training device comprising:

a frame supporting a track;

a guide member supporting a rotatable, elongate handle, the handle supporting a collar adapted to receive weight plates, the guide member supported by said track;

a one-way lock that enables movement of said handle along said track in a first direction and when engaged opposes movement in a second direction substantially opposite to said first direction, and when engaged allows movement in said first direction but not in said second direction after said movement in said first direction; and a lock release enabling said one-way lock to be engaged or disengaged.

20. The device as described in claim 19, wherein said track is a track selected from the group consisting of a linear bearing rod and a channel.

21. The device as described in claim 19, wherein said track is of a shape selected from the group consisting of substantially linear, curvilinear and arcuate.

22. The device as described in claim 19, wherein said guide member is a device selected from the group consisting of a linear bearing, a bushing and a wheel.

23. The device as described in claim 19, wherein said handle is a substantially longitudinal bar.

24. The device as described in claim 19, wherein said one-way lock is further comprised of a rack that is mounted to said frame.

25. The device as described in claim 24, wherein said rack is a notched rack.

26. The device as described in claim 25, wherein said notched rack is comprised of a plurality of saw-tooth notches with a sloped portion and a load-bearing portion.

27. The device as described in claim 24, wherein said rack is a pressure plate.

28. The device as described in claim 27, wherein said pressure plate is comprised of a substantially flat plate with a relatively high coefficient of static friction between an outer surface and a surface of a contact component of said one-way lock.

29. The device as described in claim 28, wherein said coefficient of static friction is greater than 0.5.

30. The device as described in claim 24, wherein said rack is movably mounted to said frame, the device further comprising a rack spring that at least partially supports said rack on said frame.

31. The device as described in claim 30, wherein said rack spring is a compression spring.

32. The device as described in claim 31, wherein said compression spring is a spring manufactured from a material selected from the group consisting of plastic, metal, natural rubber and synthetic rubber.

33. The device as described in claim 30, wherein said rack spring is a polyurethane bumper pad.

34. The device as described in claim 19, further comprising an indexing device that enables quantifying a position of said handle.

35. A method of providing exercise training including the steps of:

providing an exercise device including:

a frame supporting a track;

a guide member supporting a handle, which supports a collar adapted to receive weight plates, the guide member supported by said track;

a one-way lock that enables movement of said handle along said track in a first direction and opposes movement in a second direction which is opposite to the first direction; and a lock release, when actuated, allows movement of said handle in said first direction and said second direction;

moving said handle upward, by a user, in a forceful manner and releasing said handle from contact with the user; and allowing said one-way lock to secure said handle when said handle is free from contact with said user.

* * * * *